United States Patent [19]

Larson

[11] Patent Number: 4,937,158

[45] Date of Patent: Jun. 26, 1990

[54] NICKEL (II) SALTS AS CHARGING ADJUVANTS FOR ELECTROSTATIC LIQUID DEVELOPERS

[75] Inventor: James R. Larson, West Chester, Pa.

[73] Assignee: E. I. du Pont de Nemours and Company, Wilmington, Del.

[21] Appl. No.: 349,867

[22] Filed: May 10, 1989

[51] Int. Cl.[5] ..... G03G 9/12

[52] U.S. Cl. ..... 430/115; 430/137

[58] Field of Search ..... 430/115, 137

[56] References Cited

U.S. PATENT DOCUMENTS

| | | | |
|---|---|---|---|
| 4,473,630 | 9/1984 | Yokoya et al. | 430/137 X |
| 4,614,699 | 9/1986 | Kitatani et al. | 430/115 |
| 4,673,631 | 6/1987 | Fukumoto et al. | 430/115 X |
| 4,758,494 | 7/1988 | El-Sayed | 430/137 |
| 4,789,616 | 12/1988 | Croucher et al. | 430/137 |
| 4,797,342 | 1/1989 | Croucher et al. | 430/115 X |
| 4,851,316 | 7/1989 | Lu et al. | 430/115 |

*Primary Examiner*—Paul R. Michl
*Assistant Examiner*—Jeffery A. Lindeman

[57] ABSTRACT

An electrostatic liquid developer consisting essentially of (A) a nonpolar liquid having a Kauri-butanol value of less than 30, present in major amount; (B) thermoplastic resin particles, less than 30 μm average particle size, having dispersed therein a nickel (II) salt; and a nonpolar liquid soluble ionic or zwitterionic charge director compound. The process of preparation of the electrostatic liquid developer is also described. The liquid developers of the invention are useful in copying, color proofing including digital color proofing, lithographic printing plates, and resists.

56 Claims, No Drawings

NICKEL (II) SALTS AS CHARGING ADJUVANTS FOR ELECTROSTATIC LIQUID DEVELOPERS

DESCRIPTION

1. Technical Field

This invention relates to an electrostatic liquid developer having improved properties. More particularly this invention relates to an electrostatic liquid developer containing resin particles having dispersed therein a nickel (II) salt.

2. Background Art

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 30 μm average particle size as measured using the Malvern 3600E Particle Sizer described below or less than 10 μm average particle size by area when determined by Horiba CAPA-500 centrifugal automatic particle analyzer, Horiba Instruments, Inc , Irvine, CA. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, an aromatic hydrocarbon, metallic soap, etc. to the liquid toner comprising the thermoplastic resin, dispersant nonpolar liquid and preferably a colorant. Such liquid developers provide images of good resolution, but it has been found that charging and image quality are particularly pigment dependent. Some formulations, suffer from poor image quality manifested by low resolution, poor transfer efficiency and poor solid area coverage (density). In order to overcome such problems much research effort has been expended to develop new type charge directors and/or charging adjuvant for electrostatic liquid toners.

It has been found that the above disadvantages can be overcome and developers having improved charging properties, etc. prepared containing a dispersant nonpolar liquid, ionic or zwitterionic charge director compound, a thermoplastic resin having dispersed therein an adjuvant of the invention. Depending on the charge director used the developers may be positive or negative. The improved electrostatic liquid developer when used to develop an electrostatic image results in improved image quality, transfer efficiency and improved solid area coverage independent of any pigment and the charge director present.

DESCLOSURE OF THE INVENTION

In accordance with this invention there is provided an electrostatic liquid developer having improved charging characteristics consisting essentially of (A) a nonpolar liquid having a Kauri-butanol value of less than 30, present in a major amount, (B) thermoplastic resin particles having dispersed therein a nickel (II) salt, the resin particles having an average particle size of less than 30 μm, and (C) a nonpolar liquid soluble ionic or zwitterionic charge director compound In accordance with an embodiment of this invention there is provided a process for preparing electrostatic liquid developer for electrostatic imaging comprising (A) dispersing at an elevated temperature in a vessel a thermoplastic resin, a nickel (II) salt, a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average particle size of less than 30 μm from the particulate media, and (D) adding to the dispersion a nonpolar liquid soluble ionic or zwitterionic charge director compound.

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as fine particle size oxides, adjuvant, e.g., polyhydroxy compound, aminoalcohol, polybutylene succinimide, metallic soap, aromatic hydrocarbon, etc.

Aminoalcohol means that there is both an amino functionality and hydroxyl functionality in one compound.

Conductivity is the conductivity of the developer measured in picomhos (pmho)/cm at 5 hertz and 5 volts.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C.

and 191° C., Isopar ®-K between 177° C. and 197° C., Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, e.g., pigment component, adjuvant, etc.

Useful thermoplastic resins or polymers include: ethylene vinyl acetate (EVA) copolymers (Elvax ® resins, E. I. du Pont de Nemours and Company, Wilmington, DE), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, DE, etc., or blends thereof; acrylic resins, such as a copolymer of acrylic or methacrylic acid (optional but preferred) and at least one alkyl ester of acrylic or methacrylic acid wherein alkyl is 1-20 carbon atoms, e.g., methyl methacrylate (50-90%)/methacrylic acid (0-20%)/ethyl hexyl acrylate (10-50%); and other acrylic resins including Elvacite ® acrylic resins, E. I. du Pont de Nemours and Company, Wilmington, DE or blends of such resins. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 54 and a melt index of 100 and 500 determined at 190° C., respectively.

The thermoplastic resins described above have dispersed therein a nickel (II) salt wherein the anionic component of said salt is preferably selected from the group consisting of fluoride, chloride, carbonate, acetate, hydroxide, sulfate, borate, sulfonate, phosphate, benzoate, nitrate, cyanide, formate, oxalate, sulfamate, etc. As shown in Control 4 and 6 below, the bromide salt is found to give unsatisfactory results. The iodide salt also gives unsatisfactory results. The nickel salt is present in 0.1 to 40 percent by weight of toner solids, preferably to 10 percent by weight based on the total weight of the developer solids. The method whereby the nickel (II) salt is dispersed in the thermoplastic resin is described below.

In addition, the resins have the following preferred characteristics:

1. Be substantially able to disperse the adjuvant, colorant, e.g., pigment,
2. Be substantially insoluble in the dispersant liquid at temperatures below 40° C., so that the resin will not dissolve or solvate in storage,
3. Be able to solvate at temperatures above 50° C.,
4. Be able to be ground to form particles between 0.1 μm and 15 μm, in diameter,
5. Be able to form a particle of less than 30 μm average particle size, e.g., determined by Malvern 3600E Particle Sizer, manufactured by Malvern, Southborough, MA. The Malvern 3600E Particle Sizer uses laser diffraction light scattering of stirred samples to determine average particle sizes.
6. Be able to fuse at temperatures in excess of 70° C.

By solvation in 3. above, the resins forming the toner particles will become swollen, gelatinous or softened.

Suitable nonpolar liquid soluble ionic or zwitterionic charge director compounds (C), which are generally used in an amount of 0.25 to 1500 mg/g, preferably 2.5 to 400 mg/g developer solids, include: lecithin, Basic Calcium Petronate ®, Basic Barium Petronate ® oil-soluble petroleum sulfonate, manufactured by Sonneborn Division of Witco Chemical Corp., New York, NY, alkyl succinimide manufactured by Chevron Chemical Company of California; Emphos ® D70-30C and Emphos® F27-85, sodium salts of phosphated mono- and diglycerides with unsaturated and saturated acid substituents, respectively, etc. manufactured by Witco Chemical Corp., supra; etc.

As indicated above, colorants may be dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments include:

PIGMENT LIST

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazine ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | Yellow 14 |
| L75-1331 Yellow | Sun Chem. | Yellow 17 |
| L75-2337 Yellow | Sun Chem. | Yellow 83 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black (Blackness Index 155) |

Other ingredients may be added to the electrostatic liquid developer, such as fine particle size oxides, e.g., silica, alumina, titania, etc.; preferably in the order of 0.5 μm or less can be dispersed into the liquefied resin. These oxides can be used instead of the colorant or in combination with the colorant. Metal particles can also be added.

Another additional component of the electrostatic liquid developer is an adjuvant which can be selected from the group consisting of polyhydroxy compound which contains at least 2 hydroxy groups, aminoalcohol, polybutylene succinimide, metallic soap, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc. as described in Mitchell U.S. Pat. No. 4,734,352.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc. as described in Larson U.S. Pat. No. 4,702,985.

polybutylene succinimide: OLOA ®-1200 sold by Chevron Corp., analysis information appears in Kosel U.S. Pat. No. 3,900,412, column 20, lines 5 to 13, the disclosure of which is incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

metallic soap: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates; etc. The metallic soap is dispersed in the thermoplastic resin as described in Trout U.S. Pat. Nos. 4,707,429 and 4,740,444.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc. as described in Mitchell U.S. Pat. No. 4,631,244.

The disclosures of the above-listed U.S. patents describing the adjuvants are incorporated herein by reference.

The particles in the electrostatic liquid developer have an average particle size of less than 30 μm as measured by Malvern 3600E Particle Sizer described above, preferably the average particle size is less than 15 μm. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary) are placed at least one of thermoplastic resin, nickel (II) salt, and dispersant polar liquid described above. Generally the resin, optional colorant, nickel (II) salt, and dispersant nonpolar liquid are placed in the vessel prior to starting the dispersing step. Optionally the colorant can be added after homogenizing the resin and the dispersant nonpolar liquid. Polar liquid can also be present in the vessel, e.g., up to 100% based on the weight of total developer. The dispersing step is generally accomplished at elevated temperature, i.e., the temperature of ingredients in the vessel being sufficient to plasticize and liquefy the resin but being below that at which the dispersant nonpolar liquid or polar liquid, if present, degrades and the resin and/or colorant, if present, decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc., selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar liquid present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with or without the presence of additional liquid with particulate media to prevent the formation of a gel or solid mass; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size of less than 30 μm, as determined by a Malvern 3600E Particle Sizer described above, are formed by grinding for a relatively short period of time. Throughout the specification and claims the average particle size is determined by the Malvern instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion may be reduced by the addition of additional dispersant nonpolar liquid as described previously above. The dilution is normally conducted to reduce the concentration of toner particles to between 0.1 to 15 percent by weight, preferably 0.3 to 3.0, and more preferably 0.5 to 2 weight percent with respect to the dispersant nonpolar liquid. One or more nonpolar liquid soluble charge director compounds (C), of the type set out above, can be added to impart a positive or negative charge, as desired. The addition may occur at any time during the process; preferably at the end of the process, e.g., after the particulate media, if used, are removed and the reduction of concentration of toner particles is accomplished. If a diluting dispersant nonpolar liquid is also added, the charge director compound can be added prior to, concurrently with, or subsequent thereto. If an adjuvant compound of a type described above has not been previously added in the preparation of the developer, it can be added prior to or subsequent to the developer being charged.

Other process embodiments for preparing the electrostatic liquid developer include:

(A) dispersing a colorant and a nickel (II) salt in a thermoplastic resin in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average particle size of less than 30 μm from the particulate media, and (E) adding additional nonpolar liquid, polar liquid or combinations thereof to reduce the concentration of toner particles to between 0.1 to 15 percent by weight with respect to the liquid; and (F) adding to the dispersion a liquid soluble ionic or zwitterionic charge director compound; and (A) dispersing a colorant and a nickel (II) salt in a thermoplastic resin in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average particle size of less than 30 μm from the particulate media, (F) adding additional nonpolar liquid, polar liquid, or combinations thereof to reduce the concentration of toner particles to between 0.1 to 15 percent by weight with respect to the developer liquid; and (G) adding to the dispersion a liquid soluble ionic or zwitterionic charge director compound.

A preferred mode of the invention is described in Example 1.

INDUSTRIAL APPLICABILITY

The electrostatic liquid developers of this invention demonstrate improved image quality, resolution, solid area coverage (density), toning of fine details, evenness of toning, and reduced squash independent of charge director and pigment present. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image. Other uses are envisioned for the electrostatic liquid developers include: digital color proofing, lithographic printing plates, and resists.

EXAMPLES

The following controls and examples wherein the parts and percentages are by weight illustrate but do not limit the invention. In the examples the melt indices were determined by ASTM D 1238, Procedure A, the average particle sizes were determined by a Malvern 3600E Particle Sizer, manufactured by Malvern, Southborough, Mass. as described above, the conductivity was measured in picomhos (pmho)/cm at 5 hertz and low voltage, 5 volts, and the density was measured using a Macbeth densitometer model RD918. The resolution is expressed in the Examples in line pairs/mm (lp/mm). Aldrich Chemical Co., Milwaukee, Wis. is designated Aldrich in the Examples and Controls below.

CONTROL 1

The following ingredients were placed in a Union Process 01 Attritor, Union Process Company, Akron, Ohio:

| Ingredient | Amount (g) |
|---|---|
| Copolymer of ethylene (89%) and methacrylic acid (11%) melt index at 190° C. is 100, Acid No. is 66 | 25 |
| Mobay R6700 pigment, manufactured by Mobay Chemical Corp., Haledon, NJ | 6.3 |
| Isopar ®-L, nonpolar liquid having a Kauri-butanol value of 27, Exxon Corporation | 170 |

-continued

The ingredients were heated to 100° C. ±10° C. in the attritor and milled with 0.1875 inch (4.76 mm) diameter carbon steel balls for 0.5 hour. The attritor was cooled to room temperature while the milling was continued. Milling was continued for 22 hours to obtain toner particles with an average size of 6 μm. The particulate media were removed and the dispersion of toner particles was then diluted to 1.5 percent solids with additional Isopar ®-L. To 1500 grams of the dispersion were added 10 grams of 10% Emphos ® D70-30C sodium glyceryl oleate phosphate, Witco Chemical Corp., N.Y., NY (44 mg/g of toner solids) in Isopar ®-L. Image quality was determined using a Savin 870 copier at standard mode: charging corona set at +6.8 Kv, development bias set at +50 volts, and transfer corona set at +8.0 Kv using a normal image target, i.e., black areas on target image are toned with negative toner and white areas remain untoned with negative toner. Carrier sheets such as Plainwell offset enamel paper number 3 class a 60 lb. test, and Savin 2200 paper were used. Results are shown in Table 1 below. Image quality was also determined using the Savin 870 copier under positive toner test conditions: charging corona set at +6.8 Kv, development bias set at 650 volts, and transfer corona set at −6.6 Kv using a reversal image target, i.e., black areas on target image are toned with negative toner and white areas on target image are toned with positive toner with gray areas remaining untoned as background. Toner gave an image expected for a negative toner.

EXAMPLE 1

Control 1 was repeated with the following exception: 0.75 gram of $NiCl_2.6H_2O$ (Aldrich, 98%) was added to the Union Process 01 attritor prior to the initial milling. Toner particles with an average size of 5 μm were obtained. The toner gave an image expected for a positive toner under standard and positive toner test conditions. Results obtained under positive toner test conditions are shown in Table 1 below.

TABLE 1

| TONER | ADDITIVE | TONER CHARGE | PAPER | DENSITY | RESOLUTION (1 p/mm) | TRANSFER EFFICIENCY |
|---|---|---|---|---|---|---|
| CONTROL 1 | NONE | NEG | SAVIN | 0.49 | 6 | 49% |
| | | | OFFSET | 1.28 | 5 | 76% |
| EXAMPLE 1 | $NiCl_2.6H_2O$ | POS | SAVIN | 0.31 | 8 | 46% |
| | | | OFFSET | 0.65 | 10 | 79% |

CONTROL 2

The following ingredients were placed in a Union Process IS Attritor, Union Process Company, Akron, Ohio:

| Amount (g) | Ingredient |
|---|---|
| Copolymer of ethylene (91%) and methacrylic acid (9%) melt index at 190° C. is 500, Acid No. is 54. | 75 |
| Mobay R6700 pigment, manufactured | 8.1 |

-continued

| Amount (g) | Ingredient |
|---|---|
| by Mobay Chemical Corp., Haledon, NJ | |
| Isopar ®-L, nonpolar liquid having a Kauri-butanol value of 27, Exxon Corporation | 420 |

The ingredients were heated to 100° C.±10° C. in the attritor and milled at a rotor speed of 230 rpm with 0.1875 inch (4.76 mm) diameter carbon steel balls for 1 hour. The attritor was cooled to room temperature while the milling was continued at a rotor speed of 330 rpm for 5 hours to obtain toner particles with an average size of 6.9 μm. The particulate media were removed and the dispersion of toner particles was then diluted to 1.5 percent solids with additional Isopar ®-L. To 1500 grams of the dispersion were added 10% Basic Barium Petronate ® (11.25 grams), Witco Chemical Corp., N.Y., NY, (50.0 mg/g of toner solids) in Isopar ®-L. Image quality was determined using a Savin 870 copier at standard mode: charging corona set at +6.8 Kv, development bias set at +50 volts, and transfer corona set at +8.0 Kv using a normal image target, i.e., black areas on target image are toned with negative toner and white areas remain untoned with negative toner. Carrier sheets such as Plainwell offset enamel paper number 3 class a 60 lb. test, and Savin 2200 paper were used. Results are shown in Table 2 below. Toner gave an image expected for a negative toner.

EXAMPLE 2

The following ingredients were placed in a Union Process 01 Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 25 |
| Mobay R6700 pigment, manufactured by Mobay Chemical Corp., Haledon, NJ | 2.7 |
| $NiCl_2.6H_2O$ (Fisher Scientific, Pittsburgh, PA) | 0.761 |
| Isopar ®-L, nonpolar liquid having a Kauri-butanol value of 27, Exxon Corporation | 140 |

The ingredients were heated to 100° C.±10° C. in the attritor and milled with 0.1875 inch (4.76 mm) diameter carbon steel balls for 1 hour. The attritor was cooled to room temperature while the milling was continued for 3 hours to obtain toner particles with an average size of 6.5 μm. The particulate media were removed and the dispersion of toner particles was then diluted to 1.5 percent solids with additional Isopar ®-L. The toner was charged and tested as in CONTROL 2. Toner gave an image expected for a negative toner. Results are found in Table 2 below.

TABLE 2

| TONER | ADDITIVE | TONER CHARGE | PAPER | DENSITY | RESOLUTION (1 p/mm) | TRANSFER EFFICIENCY |
|---|---|---|---|---|---|---|
| CONTROL 2 | NONE | NEG | SAVIN | 1.1 | 6 | 1% |
| | | | OFFSET | 1.4 | 6 | 91% |
| EXAMPLE 2 | $NiCl_2.6H_2O$ | NEG | SAVIN | 1.0 | 10 | 78% |
| | | | OFFSET | 1.3 | 11 | 90% |

CONTROL 3

The following ingredients were placed in a Union Process 01 Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 29.7 |
| Heucophthal Blue G XBT-583D Heubach, Inc., Newark, NJ | 3.3 |
| Isopar ®-L, nonpolar liquid having a Kauri-butanol value of 27, Exxon Corporation | 135 |

The ingredients were heated to 100° C.±10° C. in the attritor and milled with 0.1875 inch (4.76 mm) diameter carbon steel balls for one hour. The attritor was cooled to room temperature while the milling was continued for 2 hours to obtain toner particles with an average size of 5.9 μm. The particulate media were removed and the dispersion of toner particles was then diluted to 1.0 percent solids with additional Isopar ®-L. To 1500 grams of the dispersion were added 7.5 grams of Basic Barium Petronate ®, Witco Chemical Corp., N.Y., NY, in Isopar ®-L. Image quality was determined using a Savin 870 copier at standard mode: charging corona set at +6.8 Kv, development bias set at +50 volts, and transfer corona set at +6.6 Kv using a normal image target, i.e., black areas on target image are toned with negative toner and white areas remain untoned with negative toner. Carrier sheets such as Plainwell offset enamel paper number 3 class a 60 lb. test, and Savin 2200 paper were used. Results are shown in Table 3 below. Toner gave an image expected for a negative toner.

CONTROL 4

A cyan toner was prepared as described in Control with the following exception: 0.7 gram of $NiBr_2.xH_2O$ (Aldrich, 98%) was added to the Union Process 01 attritor prior to the initial milling step. Results are shown in Table 3 below.

EXAMPLE 3

Three cyan toners were prepared and tested as described in Control 3 with the following exceptions: the nickel salts are identified and the toner samples 3A-C, were added in the amounts indicated in Table 3 below prior to the initial milling step. Toner sample 3B was diluted to 0.75% solids. Results are shown in Table 3 below.

TABLE 3

| TONER SAMPLE | ADJ. | AMT. (g) | COND. (pmho/cm) | TONER CHARGE | PAPER | DEN-SITY | RES. (1 p/mm) |
|---|---|---|---|---|---|---|---|
| CONTROL 3 | NONE | — | 25 | NEG | OFFSET | 0.55 | 3 |
| CONTROL 4 | $NiBr_2$[1] | 0.70 | 18 | NO IMAGE | | | |
| EXAMPLE 3A | $NiCl_2$[2] | 0.76 | 19 | POS* | OFFSET | 0.23 | 8 |
| EXAMPLE 3B | $NiCO_3$[3] | 0.40 | 21 | NEG | OFFSET | 0.49 | 4 |
| EXAMPLE 3C | $Ni(OH)_2$[4] | 0.30 | 28 | NEG | OFFSET | 0.92 | 6 |

*Image quality was determined using Savin 870 under positive toner test conditions: charging corona set at +6.8 Kv, development bias set at +650 volts, and transfer corona set at −6.6 Kv, reversal image target (black areas on target image with negative toner, white areas on target image with positive toner, gray areas are background.)

[1]is $NiBr_2.xH_2O$ (Aldrich, 98%)

[2]is $NiCl_2.6H_2O$ (Aldrich, 99%)

[3]is $NiCO_3.xH_2O$ (Aldrich)

[4]is $Ni(OH)_2$ (Aldrich, 97%)

CONTROL 5

The toner was prepared as in Control 3 with the following exception: the toner was diluted to 1150 grams of 1% solids and charged with 9.6 grams of 10% Emphos ® D70-30C described in Control 1, 83.3 mg/g of toner solids. Image quality was determined using the Savin 870 copier under positive toner test conditions: charging corona set at +6.8 Kv, development bias set at +650 volts, and transfer corona set at −6.6 Kv using a reversal image target, i.e., black areas on target image are toned with negative toner and white areas on target image are toned with positive toner with gray areas remaining untoned as background. Results are found in Table 4 below.

CONTROL 6

A cyan toner was prepared as described in Control 5 with the following exception: 0.70 gram of $NiBr_2.xH_2O$ was added to the Union Process 01 attritor prior to the initial milling step. Results are found in Table 4 below.

EXAMPLE 4

Three cyan toners were prepared and tested as described in Control 5 with the following exception: the nickel salts identified in Table 4, Samples 4A–4C respectively, were added to the Union Process 01 attritor in the amounts indicated in Table 4 prior to the initial milling step. Results are shown in Table 4 below.

TABLE 4

| EXAMPLE | ADJ. | COND. (pmho/cm) | TONER CHARGE | PAPER | DENSITY | RES. (1 p/mm) |
|---|---|---|---|---|---|---|
| CONTROL 5 | NONE | 8 | | | NO IMAGE | |
| CONTROL 6 | $NiBr_2$ | 7 | | | NO IMAGE | |
| EXAMPLE 4A | $NiCl_2$ | 7 | POS | OFFSET | 0.40 | 8 |
| EXAMPLE 4B | $NiCO_3$ | 6 | POS | OFFSET | 0.11 | 8 |
| EXAMPLE 4C | $Ni(OH)_2$ | 6 | | | NO IMAGE | |

CONTROL 7

A black toner was prepared by placing the following ingredients in a Union Process IS attritor, Union Process Co., Akron, Ohio:

| Ingredient | Amount (g) |
|---|---|
| Terpolymer of methyl methacrylate (67%) methacrylic acid (3%) and ethylhexyl acrylate (30%), weight average molecular weight of 172,000, acid no. of 13 | 340 |
| Uhlich BK 8200, laked carbon black, Paul Uhlich and Co., Inc., Hastings-On-Hudson, NY | 85 |
| Isopar ®-L, nonpolar liquid having a Kauri-butanol value of 27, Exxon Corporation | 1700 |

The ingredients were heated to 100° C.±10° C. in the attritor and milled at a rotor speed of 230 rpm with 0.1875 inch (4.76 mm) diameter carbon steel balls for 1 hour. The attritor was cooled to room temperature while the milling was continued at a rotor speed of 330 rpm for 7 hours to obtain toner particles with an average size of 8.0 μm. The particulate media were removed and the dispersion of toner particles was then diluted to 1.5 percent solids with additional Isopar ®-L. To 2000 grams of the dispersion were added 24 grams of 10% Emphos ® D70-30C described in Control 1 in Isopar ®-L 80 mg/g of toner solids. Image quality was determined using a Savin 870 copier under positive test conditions described in Control 1. Carrier sheets such as Plainwell offset enamel paper number 3 class a 60 lb. test, and Savin 2200 paper were used. Results are shown in Table 5 below.

EXAMPLE 5

A black toner was prepared and tested as in Control 7 with the following exception: 2.3 grams of $NiCl_2.6H_2O$ (Aldrich, 99%) were added to the Union Process 1S attritor prior to the initial milling step. Results are shown in Table 5 below.

TABLE 5

| EXAMPLE | ADJ. | COND. (pmho/cm) | TONER CHARGE | PAPER | DENSITY | RES. (1 p/mm) |
|---|---|---|---|---|---|---|
| CONTROL 7 | NONE | 24 | POS | SAVIN | 0.15 | 6 |
| | | | | OFFSET | 0.26 | 7 |
| EXAMPLE 5 | $NiCl_2.6H_2O$ | 23 | POS | SAVIN | 0.60 | 8 |

TABLE 5-continued

| EXAMPLE | ADJ. | COND. (pmho/cm) | TONER CHARGE | PAPER | DENSITY | RES. (1 p/mm) |
|---|---|---|---|---|---|---|
| | | | | OFFSET | 1.10 | 8 |

I claim:

1. An electrostatic liquid developer having improved charging characteristics consisting essentially of
   (A) a nonpolar liquid having a Kauri-butanol value of less than 30, present in a major amount,
   (B) thermoplastic resin particles having dispersed therein a nickel (II) salt, the resin particles having an average particle size of less than 30 μm, and
   (C) a nonpolar liquid soluble honhc or zwitterionic charge director compound.

2. An electrostatic liquid developer according to claim 1 wherein the nickel (II) salt anion is selected from the group consisting of chloride, fluoride, phosphate, sulfate, acetate, hydroxide, nitrate, carbonate, benzenesulfonate, benzoate, citrate, cyanide, formate, oxalate, and sulfamate.

3. An electrostatic liquid developer according to claim 2 wherein the nickel II salt is nickel chloride.

4. An electrostatic liquid developer according to claim 3 wherein the nickel (II) salt is $NiCl_2.6H_2O$.

5. An electrostatic liquid developer according to claim 2 wherein the nickel (II) salt is nickel carbonate.

6. An electrostatic liquid developer according to claim 2 wherein the nickel (II) salt is nickel hydroxide.

7. An electrostatic liquid developer according to claim 1 wherein component (A) is present in 85 to 99.9% by weight, based on the total weight of liquid developer, the total weight of developer solids is 0.1 to 15.0% by weight, and component (C) is present in an amount of 0.25 to 1500 mg/g developer solids.

8. An electrostatic liquid developer according to claim 7 wherein the nickel (II) salt is present in 0.1 to 40% by weight based on the total weight of the developer solids.

9. An electrostatic liquid developer according to claim 1 containing up to about 60% by weight of a colorant based on the total weight of developer solids.

10. An electrostatic liquid developer according to claim 9 wherein the colorant is a pigment.

11. An electrostatic liquid developer according to claim 9 wherein the colorant is a dye.

12. An electrostatic liquid developer according to claim 1 wherein a fine particle size oxide is present.

13. An electrostatic liquid developer according to claim 1 wherein an additional compound is present which is an adjuvant selected from the group consisting of polyhydroxy compound, aminoalcohol, polybutylene succinimide, metallic soap, and an aromatic hydrocarbon.

14. An electrostatic liquid developer according to claim 9 wherein an additional compound is present which is an adjuvant selected from the group consisting of polyhydroxy compound, aminoalcohol, polybutylene succinimide, metallic soap, and an aromatic hydrocarbon.

15. An electrostatic liquid developer according to claim 13 wherein a polyhydroxy adjuvant compound is present.

16. An electrostatic liquid developer according to claim 13 wherein an aminoalcohol adjuvant compound is present.

17. An electrostatic liquid developer according to claim 13 wherein a polybutylene succinimide adjuvant compound is present.

18. An electrostatic liquid developer according to claim 13 wherein a metallic soap adjuvant compound is present dispersed in the thermoplastic resin.

19. An electrostatic liquid developer according to claim 13 wherein an aromatic hydrocarbon adjuvant compound having a Kauri-butanol value of greater than 30 is present.

20. An electrostatic liquid developer according to claim 16 wherein the aminoalcohol adjuvant compound is triisopropanolamine.

21. An electrostatic liquid developer according to claim 1 wherein the thermoplastic resin is a copolymer of ethylene and an α,β-ethylenically unsaturated acid selected from the group consisting of acrylic acid and methacrylic acid.

22. An electrostatic liquid developer according to claim 1 wherein the thermoplastic resin is polystyrene.

23. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

24. An electrostatic liquid developer according to claim 9 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

25. An electrostatic liquid developer according to claim 23 wherein the thermoplastic resin is a copolymer of ethylene (89%)/methacrylic acid (11%) having a melt index at 190° C. of 100.

26. An electrostatic liquid developer according to claim 1 wherein the particles have an average particle size of less than 15 μm.

27. An electrostatic liquid developer according to claim 1 wherein component (C) is an oil-soluble petroleum sulfonate.

28. An electrostatic liquid developer according to claim 1 wherein component (C) is a sodium salt of phosphated mono- and diglycerides with unsaturated or saturated acid substituents.

29. A process for preparing electrostatic liquid developer for electrostatic imaging comprising
   (A) dispersing at an elevated temperature in a vessel a thermoplastic resin, a nickel (II) salt, a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes,
   (B) cooling the dispersion, either
      (1) without stirring to form a gel or solid mass, followed by shredding the gel or solid mass and grinding by means of particulate media with or without the presence of additional liquid;
      (2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average particle size of less than 30 μm from the particulate media, and (D) adding to the dispersion a nonpolar liquid soluble ionic or zwitterionic charge director compound.

30. A process according to to claim 29 wherein the nickel (II) salt anion is selected from the group consisting of chloride, fluoride, phosphate, sulfate, acetate, hydroxide, nitrate, carbonate, benzenesulfonate, benzoate, citrate, cyanide, formate, oxalate, and sulfamate.

31. A process according to claim 30 wherein the nickel (II) salt is nickel chloride.

32. A process according to claim 31 wherein the nickel (II) salt is $NiCl_2.6H_2O$.

33. A process according to claim 30 wherein the nickel (II) salt is nickel carbonate.

34. A process according to claim 30 wherein the nickel (II) salt is nickel hydroxide.

35. A process according to claim 29 wherein there is present in the vessel up to 100% by weight of a polar liquid having a Kauri-butanol value of at least 30, the percentage based on the total weight of the developer liquid.

36. A process according to claim 29 wherein the particulate media are selected from the group consisting of stainless steel, carbon steel, ceramic, alumina, zirconia, silica and sillimanite.

37. A process according to claim 29 wherein the thermoplastic resin is a copolymer of ethylene and an α-β-ethylenically unsaturated acid selected from the group consisting of acrylic acid and methacrylic acid.

38. A process according to claim 29 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

39. A process according to claim 38 wherein the thermoplastic resin is a copolymer of ethylene (89%)/methacrylic acid (11%) having a melt index at 190° C. of 100.

40. A process according to claim 29 wherein the charge director compound is an oil-soluble petroleum sulfonate.

41. A process according to claim 29 wherein the charge director is a sodium salt of phosphated mono and diglycerides with unsaturated or saturated acid substituents.

42. A process according to claim 29 wherein additional dispersant nonpolar liquid, polar liquid, or combinations thereof is present to reduce the concentration of toner particles to between 0.1 to 15 percent by weight with respect to the developer liquid.

43. A process according to claim 42 wherein the concentration of toner particles is reduced by additional dispersant nonpolar liquid.

44. A process according to claim 29 wherein cooling the dispersion is accomplished while grinding by means of particulate media to prevent the formation of a gel or solid mass with or without the presence of additional liquid.

45. A process according to claim 29 wherein cooling the dispersion is accomplished without stirring to form a gel or solid mass, followed by shredding the gel or solid mass and grinding by means of particulate media with or without the presence of additional liquid.

46. A process according to claim 29 wherein cooling the dispersion is accomplished with stirring to form a viscous mixture and grinding by means of particulate media with or without the presence of additional liquid.

47. A process according to claim 29 wherein an adjuvant compound selected from the group consisting of polyhydroxy compound aminoalcohol, polybutylene succinimide, metallic soap, and an aromatic hydrocarbon is added during the dispersing step (A).

48. A process according to claim 47 wherein the adjuvant compound is an aminoalcohol.

49. A process according to claim 48 wherein the aminoalcohol is triisopropanolamine.

50. A process according to claim 42 wherein an adjuvant compound selected from the group consisting of polyhydroxy compound, aminoalcohol, polybutylene succinimide, metallic soap, and an aromatic hydrocarbon is added.

51. A process according to claim 50 wherein the adjuvant compound is a polyhydroxy compound.

52. A process according to claim 51 wherein the polyhydroxy compound is ethylene glycol.

53. A process according to claim 50 wherein the adjuvant compound is a metallic soap dispersed in the thermoplastic resin.

54. A process according to claim 53 wherein the metallic soap adjuvant compound is aluminium stearate dispersed in the thermoplastic resin.

55. A process for preparing electrostatic liquid developer comprising (A) dispersing a colorant and a nickel (II) metal salt in a thermoplastic resin in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average particle size of less than 30 μm from the particulate media, and (E) adding additional nonpolar liquid, polar liquid or combinations thereof to reduce the concentration of toner particles to between 0.1 to 15 percent by weight with respect to the liquid; and (F) adding to the dispersion a liquid soluble ionic or zwitterionic charge director compound.

56. A process for preparing electrostatic liquid developer comprising (A) dispersing a colorant and a nickel (II) salt in a thermoplastic resin in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average particle size of less than 30 μm from the particulate media, and (F) adding additional nonpolar liquid, polar liquid, or combinations thereof to reduce the concentration of toner particles to between 0.1 to 15 percent by weight with respect to the developer liquid; and (G) adding to the dispersion a liquid soluble ionic or zwitterionic charge director compound.

* * * * *